US005264142A

United States Patent [19]

Hessel et al.

[11] Patent Number: 5,264,142

[45] Date of Patent: * Nov. 23, 1993

[54] STABILIZATION OF PEROXYGEN BLEACH IN ENZYME-CONTAINING HEAVY DUTY LIQUIDS

[75] Inventors: John F. Hessel, Metuchen; Daniel J. Kuzmenka, Lyndhurst, both of N.J.; Johannes C. Van De Pas, Vlaardingen; Cornelis B. Donker, Dordrecht, both of Netherlands; Jack T. McCown, Cresskill, N.J.

[73] Assignee: Lever Brothers Company, Division of Conopco, Inc., New York, N.Y.

[ * ] Notice: The portion of the term of this patent subsequent to Dec. 17, 2008 has been disclaimed.

[21] Appl. No.: 797,741

[22] Filed: Nov. 25, 1991

[51] Int. Cl.[5] ..... C11D 3/386; C11D 3/37; C11D 3/395; C11D 7/18

[52] U.S. Cl. ..... 252/95; 252/174.12; 252/174.23; 252/174.19; 252/100; 252/DIG. 12; 252/547; 252/DIG. 14

[58] Field of Search ..... 252/174.12, 174.23, 252/95, 174.19, 100, DIG. 12, 547, DIG. 14; 435/188, 264

[56] References Cited

U.S. PATENT DOCUMENTS

| | | | |
|---|---|---|---|
| 3,296,094 | 1/1967 | Cayle | 435/188 X |
| 3,325,364 | 6/1967 | Merritt et al. | 435/188 X |
| 3,560,392 | 8/1968 | Eymery et al. | 252/174.12 X |
| 4,243,546 | 1/1981 | Shaer | 252/174.12 |
| 4,318,818 | 3/1982 | Letton et al. | 252/174.12 |
| 4,518,694 | 5/1985 | Shaer | 252/174.12 X |
| 4,842,758 | 6/1989 | Crutzen | 252/DIG. 12 |
| 4,842,767 | 6/1989 | Warschewski et al. | 252/174.12 X |
| 5,073,292 | 12/1991 | Hessel et al. | 252/174.12 |

FOREIGN PATENT DOCUMENTS

| | | |
|---|---|---|
| 293040 | 5/1987 | European Pat. Off. . |
| 378261 | 7/1990 | European Pat. Off. . |

*Primary Examiner*—W. J. Shine
*Assistant Examiner*—Douglas J. McGinty
*Attorney, Agent, or Firm*—Ronald A. Koatz

[57] ABSTRACT

The present application provides heavy duty liquids in which enzyme stability is maintained without sacrificing peroxygen bleach stability. In one embodiment of the invention stability is provided using protein having a MW of from about 1,000 to about under 50,000. In a second embodiment, stability is provided using a carboxylic acid selected from the group consisting of acetic acid, propionic acid, adipic acid and salts thereof.

8 Claims, No Drawings

STABILIZATION OF PEROXYGEN BLEACH IN ENZYME-CONTAINING HEAVY DUTY LIQUIDS

BACKGROUND OF THE INVENTION

1. Field of the Invention

The present invention relates to heavy duty liquid (HDL) compositions which contain both proteolytic enzymes and peroxygen bleach. In particular, the invention relates to HDL compositions in which enzyme stability is maintained without at the same time sacrificing peroxygen bleach stability. The invention further relates to methods of improving peroxygen bleach stability in HDL compositions containing proteolytic and lipolytic enzymes.

2. Prior Art

A peroxygen bleach compound in a heavy duty liquid composition which contains no enzymes stabilizers will remain relatively stable although, of course, the stability of enzymes present in such compositions is seriously compromised. While the addition of enzyme stabilizers increases the stability of the enzymes present, the enzyme stabilizers will simultaneously decrease the stability of peroxygen bleach compounds in the composition.

The addition of a glycerol/borate stabilization system to compositions containing both enzymes and peroxygen bleach, for example, results in compositions having good enzyme stability but poor peroxygen bleach stability.

Unexpectedly, applicants have found that using proteins having a molecular weight under 50,000 as stabilizers in HDL compositions containing peroxygen bleach help to stabilize the enzyme while simultaneously destabilizing the peroxygen bleach to a much lesser extent relative to the peroxygen bleach destabilization caused by other enzyme stabilizers, e.g., glycerol.

In a second embodiment of the invention, applicants have found that specific carboxylic acid enzyme stabilizers (e.g. acetic acid, propionic acid, adipic acid) are far superior compared to formic acid stabilizer, for example, in their ability to stabilize enzymes while remaining far less harsh on peroxygen bleach (i.e. causing far less peroxygen bleach destabilization).

The prior art includes many examples of enzyme stabilizers, including the use of carboxylates and proteins as stabilizers. For example, the use of carboxylates as stabilizers is disclosed in U.S. Pat. No. 4,243,546 to Shaer, U.S. Pat. No. 4,318,818 to Letton et al., and U.S. Pat. No. 4,518,694 to Shaer; while the use of proteins as stabilizers disclosed in U.S. Pat. No. 4,842,758 to Crutzen et al., U.S. Pat. No. 4,842,767 to Warshewski et al., U.S. Pat. No. 3,560,392 to Eymery et al., U.S. Pat. No. 3,296,094 to Cayle and U.S. Pat. No. 3,325,364 to Merritt et al.

In none of these references, however, is there disclosed the use of either proteins having a molecular weight below 50,000 or specific carboxylate compounds in compositions comprising peroxygen bleach; or is there any recognition that these specific stabilizers can stabilize enzymes while having little or no effect on peroxygen bleach stability.

In applicants copending U.S. Ser. No. 592,942, the use of quaternary nitrogen compounds for enzyme stabilization is disclosed. There is no teaching or suggestion that proteins having a molecular weight under 50,000, particularly cationic proteins, may be used in compositions also comprising peroxygen bleach or that these stabilizers are far less harsh on peroxygen bleach than other enzyme stabilizers, e.g., glycerol.

In European Publication No. 378,261 (Procter & Gamble), the use of peroxygen bleach in combination with formate, acetate, or propionate is disclosed in the examples. There is no indication at all from this reference that the use of acetate, propionate or adipate greatly enhances both enzyme and bleach stability (e.g., relative to glycerol) or that bleach stability using formate is far inferior to bleach stability using acetate, propionate or adipate.

European Publication No. 293,040 (Procter & Gamble) teaches compositions using peroxygen bleach and formate. Again, there is no teaching or suggestion that acetate, propionate or adipate is far superior to formate in terms of stabilizing enzyme without simultaneously destabilizing peroxygen bleach. Further it is not clear from this reference that formate is used to stabilize both the enzyme and the bleach. Rather, stabilization of peroxygen bleach is apparently accomplished using a solvent system comprising water and a water-miscible solvent.

In short, the art fails to recognize that specific protein stabilizers may be used to stabilize enzymes while providing little or no peroxygen bleach destabilization; or that specific carboxylate stabilizers (e.g., acetate, propionate or adipate) are far superior than others (i.e., formate) for stabilizing both enzymes and peroxygen bleach in HDLs.

SUMMARY OF THE INVENTION

In one embodiment of the invention, it has now been found that proteins having a molecular weight under 50,000 may be used to enhance enzyme stability without compromising stability of peroxygen bleach in HDL compositions containing both enzymes and peroxygen bleach.

In a preferred aspect of the embodiment of the invention, the protein is a cationic protein having a molecular weight of from about 3,000 to about 30,000 and, more preferably a cationic protein having a molecular weight of about 4,000 to about 20,000.

The present invention provides specific compositions containing the defined enzyme stabilizers and further provides a method of preparing stable compositions which contain both enzyme and peroxygen bleach.

In particular, the present invention provides heavy duty liquid detergent compositions comprising:

(1) at least one of an anionic, nonionic, cationic, ampholytic or zwitterionic surfactant or a mixture of these surfactants in an amount of 5 to 85% by weight;
(2) an effective amount of enzyme;
(3) a peroxygen bleach compound in a concentration range from 2.5% to about 25% of the detergent composition; and
(4) a protein having a molecular weight under 50,000 used in a concentration range from 0.1% to 10% of the detergent formulation.

In another embodiment of the invention, the invention provides heavy duty liquid detergent compositions comprising:

(1) at least one of an anionic, nonionic, cationic, ampholytic or zwitterionic surfactant or a mixture of these surfactants in an amount of 5 to 85% by weight;
(2) an effective amount of enzyme;
(3) a peroxygen bleach compound in a concentration range from 2.5% to about 25% of the composition; and (4) a carboxylic acid or carboxylate salt selected from the group consisting of acetic acid, propionic acid, adipic acid or salts thereof in an amount of from 0.1% to about 10% by weight.

The invention further provides a method of stabilizing peroxygen bleach in an HDL containing both peroxygen bleach and enzymes which method comprises preparing the compositions of the invention.

Optional ingredients which may be added to the compositions include, but are not limited to, detergent enzymes other than proteases or lipases (such as cellulases, oxidases, amylases and the like), builders, additional enzyme stabilizers, alkalinity buffers, hydrotropes, cationic softening agents, soil release polymers, anti-redeposition agents and other ingredients such as are known in the art.

DETAILED DESCRIPTION OF THE INVENTION

The present invention relates to HDL formulations which contain both an enzyme and a peroxygen bleach compound as well as an enzyme stabilizing compound which does not simultaneously destabilize the peroxygen compound present in the HDL. The enzyme is generally selected from the group consisting of proteases and lipases.

Specifically, the heavy duty liquid (HDL) detergent compositions comprise:

(1) a surfactant detergent comprising at least one of an anionic, nonionic, cationic, ampholytic or zwitterionic surfactant or a mixture of any of these surfactant detergents;

(2) an effective amount of an enzyme selected from the group consisting of proteases and lipases;

(3) a peroxygen bleach compound; and (4) a protein having a molecular weight under 50,000.

Preferably, although not necessarily, the protein is a cationic protein having a molecular weight under 50,000, for example, from about 1,000 to about under 50,000 or from about 3,000 to about under 50,000. Most preferably, the protein stabilizer is a cationic protein having a molecular weight from about 4,000 to about 20,000.

By cationic protein is meant any protein (i.e., natural or man made) having a positive charge. These cationic proteins may be obtained in either of at least the two following ways:

(1) by hydrolyzing the protein such that there is an excess of amine groups relative to carboxylic acid groups and such that the isoelectric point is greater than 7; or (2) by reacting the protein with a substituted tertiary or quaternary amine (e.g., a substituted trialkyl amine) carrying a positive charge such that a quaternized protein is formed. To the extent that the cationic protein is derived from the reaction of a protein with the substituted tertiary or quaternary amine group, such a protein is considered a "derivatized" protein and, of course, the positive charge in the derivatized protein is obtained from the substituted amine group.

Example of substituted amine groups which may be used to form the derivatized cationic proteins of the invention include, but are not limited to, epoxy alkyl amines (e.g., epoxy propyl trimethyl ammonium chloride or glycidyl trimethyl ammonium chloride); tertiary amine alkyl chlorides (e.g., 2 diethyl amine ethyl chloride hydrochloride).

Other substituted amine groups which carry a positive charge and may be used to form a derivatized protein are well known to those skilled in the art.

In a second embodiment of the invention, the stabilizing compound (4) is selected from the group consisting of acetic acid, propionic acid, adipic acid and a salt thereof.

SURFACE ACTIVE DETERGENTS

The laundry detergent compositions of the invention may contain one or more surface active agents selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophile group, i.e. water solubilizing group such as sulfonate or sulfate group. The anionic surface active agents include the alkali metal (e.g. sodium and potassium) water soluble higher alkyl benzene sulfonates, alkyl sulfonates, alkyl sulfates and the alkyl poly ether sulfates. The preferred anionic surface active agents are the alkali metal higher alkyl benzene sulfonates and alkali metal higher alkyl sulfonates. Preferred higher alkyl sulfonate are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecyl benzene sulfonate. The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atoms of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 0 to 70%, preferably 10 to 50% and more preferably 10 to 20% by weight.

The alkali metal sulfonate can be used in admixture with the alkylbenzene sulfonate in an amount of 0 to 70%, preferably 10 to 50% by weight.

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, and ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12-15}—O—(CH_2CH_2O)_3—SO_3Na$$

Examples of suitable higher alkyl poly lower alkoxy sulfates that can be used in accordance with the present invention are $C_{12-15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt: $C_{15}$ primary alkyl tetraethoxy sulfate, sodium salt, mixed $C_{14-15}$ normal primary alkyl mixed tri- and tetraethoxy sulfate, sodium salt; stearyl pentaethoxy sulfate, sodium salt; and mixed $C_{10-18}$ normal primary alkyl triethoxy sulfate, potassium salt.

The normal alkyl poly-lower alkoxy sulfates are readily biodegradable and are preferred. The alkyl poly-lower alkoxy sulfates can be used in mixtures with each other and/or in mixtures with the above discussed higher alkyl benzene and higher alkyl sulfonates.

The alkali metal higher alkyl poly ethoxy sulfate can be used with the alkylbenzene sulfonate and/or with the alkyl sulfonate, in an amount of 0 to 70%, preferably 10 to 50% and more preferably 10 to 20% by weight of entire composition.

Nonionic Surfactant Detergent

Nonionic synthetic organic detergents which can be used with the invention, alone or in combination with other surfactants are described below.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moeity. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mole.

Exemplary of such compounds are those wherein the alkanol is of 12 to 15 carbon atoms and which contain about 7 ethylene oxide groups per mol, e.g. Neodol 25-7 and Neodol 23-6.5, Which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide group present averages about 6.5. The higher alcohols are primary alkanols.

Other useful nonionics are represented by the commercially well known class of nonionics sold under the trademark Plurafac. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, C13–C15 fatty alcohol condensed with 7 moles propylene oxide and 4 moles ethylene oxide, C13–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol trademark: Dobanol 91-5 is an ethoxylated $C_9$-$C_{11}$ fatty alcohol with an average of 5 moles ethylene oxide and Dobanol 25-7 is an ethoxylated $C_{12}$–C15 fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 7 to 9 moles, and the C9 to C11 fatty alcohols ethoxylated with about 5–6 moles, and the C9 to C11 fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R^1O—_y(Z)_x$$

wherein R is a monovalent organic radical containing from about 6 to about 30 (preferably from about 8 to about 18) carbon atoms; $R^1$ is a divalent hydrocarbon radical containing from about 2 to 4 carbons atoms; 0 is an oxygen atom; y is a number which can have an average value of from 0 to about 12 but which is most preferably zero; Z is a moiety derived from a reducing saccharide containing 5 or 6 carbon atoms; an x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Mixtures of two or more of the nonionic surfactants can be used.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Ampholytic Surfactants

Ampholytic synthetic detergents can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-solubilizing group, e.g. carboxy, sulfonate,sulfate. Examples of compounds falling within this definition are sodium 3-(dodecylamino)propionate, sodium 3-(dodecylamino)-propane-1-sulfonate, sodium 2-(dodecylamino)ethyl sulfate, sodium 2-(dimethylamino)octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic Surfactants

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The total surfactant concentration used in the compositions of the invention ranges from about 5 to about 80%, preferably 10–40% by weight.

ENZYME

The enzyme present in the HDL compositions of the invention may be a proteolytic enzyme (i.e., protease), a lipolytic enzyme or a combination of the two.

The protease added can be of vegetable, animal or microbial origin. Preferably, it is of the latter origin, which includes yeasts, fungi, molds and bacteria. Particularly preferred are bacterial subtilis in type proteases, obtained from e.g. particular strains of *B. subtilis* and *B. licheniformis*. Examples of suitable commercially available proteases are Alcalase, Savinase, Esperase, all of NOVO Industry A/S; Maxatase and Maxacal of Gist-Brocades; Kazusase of Showa Denko; BPN and BPN' proteases and so on. The amount of proteolytic enzyme, included in the composition, ranges from 0.1–50 GU/mg, based on the final composition. Naturally, mixtures of different proteolytic enzymes may be used.

A GU is a glycine unit, which is the amount of proteolytic enzyme which under standard incubation conditions produces an amount of terminal $NH_2$ -groups equivalent to 1 microgramme/ml of glycine.

Example of suitable lipases which can be used include fungal lipases producible by *Humicola lanuoinosa* and *Thermomyces lanuginosus*, or a bacterial lipases which show a positive immunological cross-reaction with the antibody of the lipase produced by the microorganism *Chromobacter viscosum* var. *lipolyticum* NRRL B-3673. This microorganism has been described in Dutch patent specification 154,269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immunodiffusion procedure according to Ouchterlony (Acta. Med. Scan., 133. pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0 : antigen in complete Freund's adjuvant
day 4 antigen in complete Freund's adjuvant
day 32 : antigen in incomplete Freund's adjuvant
day 60 : booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in this embodiment of the invention. Typical examples thereof are the lipase ex *Pseudomonas fluorescens* IAM 1057 available from Amano Pharmaceutical Co., Nagoya, Japan, under the trade-name Amano-P lipase, the lipase ex *Pseudomonas fragi* FERM P 1339 (available under the trade-name Amano-B), the lipase ex *Pseudomonas nitroreducens* var. *lipolyticum FERM* P1338, the lipase ex *Pseudomonas sp.* available under the trade-name Amano CES, the lipase ex *Pseudomonas cepacia,* lipases ex *Chromobacter viscosum,* e.g. *Chromobacter viscosum* var. *lipolyticum* NRRL B-3673, commercially available from Toyo Jozo Co., Tagata, Japan; and further Chromobacter viscosum lipases from U.S. Biochemical Corp. USA and Diosynth Co., The Netherlands, and lipases ex *Pseudomonas gladioli.*

An example of a fungal lipase as defined above is the lipase ex *Humicola lanuqinosa,* available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa* and expressing this gene in *Asoergillus oryzae,* commercially available from NOVO industry A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 2 gm/liter.

A lipase Unit (LU) is that amount of lipase which produces 1/μmol of titratable fatty acid per minute in a pH stat under the following conditions: temperature 30° C.; pH=9.0; substrate is an emulsion of 3.3 wt.% of olive oil and 3.3% gum arabic, in the presence of 13 mmol/1 $Ca^{2+}$ and 20 mmol/1 NaCl in 5 mmol/1 Tris-buffer.

Naturally, mixtures of the above lipases can be used. The lipases can be used in their non-purified form or in a purified form, e.g. purified with the aid of well-known absorption methods, such as phenyl sepharose absorption techniques.

Proteases or lipases of the invention may optionally be used with other enzymes such as cellulases, amylases and other enzymes such as known to those skilled in the art.

PEROXYGEN BLEACH

The peroxygen bleach compound is any compound capable of releasing hydrogen peroxide in an aqueous solution.

Hydrogen peroxide sources are well known in the art. They include the alkali metal peroxides, organic peroxide bleaching compounds, such as the alkali metal perborates, percarbonates, perphosphates and persulfates. Mixtures of two or more such compounds may also be suitable. Particularly preferred are sodium perborate tetrahydrate and sodium perborate monohydrate.

The peroxygen bleach compound should be present in the detergent composition in a range from about 2.5% to about 25% of the formulation.

ENZYME STABILIZER

In one embodiment of the invention, the enzyme stabilizer compound is any protein having a molecular weight of from about 1000 to about under 50,000.

Preferably, the protein is a cationic protein. By cationic is meant a protein having a positive charge wherein the positive charge may be obtained by hydrolyzing a natural or man-made protein (e.g., hydrolyzing such that there exists an excess of amines to carboxylic acids) or wherein the positive charge may be derived by reacting the protein with a substituted tertiary or quaternary amine group carrying a positive charge in order to form a quaternized protein.

Examples of such quaternized stabilizers include cationic hydrolyzed collagen, casein, keratin, wheat protein (e.g., wheat germ), silk protein, soy, corn gluten and the like.

Such a quaternized stabilizer protein, for example, has the structure defined below:

$$\text{Protein}\text{-}Y\text{-}R_1\text{-}\overset{+}{N}(R_2)(R_3)(R_5)A^-]_x$$

where Protein is a native or hydrolyzed protein such as collagen, casein, keratin, silk protein, wheat protein, soy or corn gluten.

Y is an amino acid capable of reacting with the substituted amine group. Examples of such amino acids include serine, lysine, hydroxylysine, arginine, threonine, histidine, or tyrosine; Y may also be an amino acid capable of reacting with a substituted tertiary or quaternary amine group on the protein structure;

$R_1$ is a saturated or unsaturated alkyl, aryl, alkaryl, ester of an alkyl, ester of an aryl, ester of an alkaryl, amido, alkylamine, alkoxy or alkanol group having 0 to 20 carbon atoms;

$R_2$, $R_3$ and $R_4$ are saturated or unsaturated alkyl, aryl, amido, alkylamine, alkoxy, alkanol, alkylcarboxylate, alkyl sulfate, alkylsulfonate, arylsulfonate or arylsulfate groups having 1 to 20 carbon atoms;

$A^-$ is a neutralizing anion such as a halide (Cl, Br), sulfate, organic sulfate (e.g., ethosulfate), organic acid (e.g., acetate), hydroxy acid (e.g., lactic acid), or a combination thereof; and X may be from 1to 100.

Preferably $R_2$, $R_3$ and $R_4$ are alkyl groups having 1 to 20 carbon atoms.

Specific example of proteins which may be used include triethonium hydrolyzed collagen (Quat Pro E) having the structure:

$$\text{collagen}\text{-}Y\text{-}\overset{CH_3CH_2SO_4^-}{\overset{+}{N}}\text{-}(CH_2CH_3)_3]_x$$

and steartrimonium hydrolyzed collagen (Quat Pro S) having the structure:

$$\text{Collagen}\text{-}Y\text{-}\overset{Cl^-}{\overset{+}{N}}(CH_3)_2C_{18}H_{37}]_x$$

Both are manufactured by Maybrook. Quat Coll QS (having a $C_{18}$ alkyl chain like Quat Pro S) is manufactured by Brooks.

As indicated above, the enzyme stabilizer is preferably a cationic protein (i.e., hydrolyzed natural protein or a quaternized cationic protein). Preferably the cationic protein has a molecular weight of about 3,000 to about 30,000. More preferably the protein is a cationic protein having a molecular weight of about 4,000 to about 20,000.

The protein is used at a level at about 0.1% to about 10%, preferably 0.1% to 3% of the composition.

In a second embodiment of the invention, the stabilizer is a carboxylic acid stabilizer selected from the group consisting of acetic acid, propionic acid, adipic acid and salts of these compounds.

OPTIONAL INGREDIENTS

The surfactants used in the compositions of the present invention may also have dispersed, suspended, or dissolved therein fine particles of inorganic and/or organic detergent builder salts.

The invention detergent compositions may include water soluble and/or water insoluble detergent builder salts. Water soluble inorganic alkaline builder salts which can be used alone with the detergent compound or in admixture with other builders are alkali metal carbonates, bicarbonates, borates, phosphates, polyphosphates, and silicates. (Ammonium or substituted ammonium salts can also be used). Specific examples of such salts are sodium tripolyphosphate, sodium carbonate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred.

The polyphosphate builder (such as sodium tripolyphosphate) can be supplemented with suitable organic auxiliary builders.

Suitable organic builders are polymers and copolymers of polyacrylic acid and polymaleic anhydride and the alkali metal salts thereof. More specifically such builder salts can consist of a copolymer which is the reaction product of acrylic acid and maleic anhydride which has been completely neutralized to form the sodium salt thereof. One example of such a compound is the builder commercially available under the tradename of Sokolan CP5. This builder serves when used even in small amounts to inhibit encrustation.

Examples of organic alkaline sequestrant builder salts which can be used with the detergent builder salts or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA), and triethanolammonium N-(2 hydroxyethyl) nitrilodiacetates. Mixed salts of these aminopolycarboxylates are also suitable.

Other suitable builders of the organic type include carboxylmethylsuccinates, e.g., methyloxysuccinate (CMOS); tartronates glycollates; tartrate monosuccinate, tartrate disuccinate or mixtures thereof (TMS/TDS); citrate; and small polycarboxylates. Of special value are the polyacetal carboxylates. The polyacetal carboxylates and their use in detergent compositions are described in U.S. Pat. Nos. 4,144,226, 4,315,092 and 4,146,495.

The inorganic alkali metal silicates are useful builder salts which also function to adjust or control the pH and to make the composition anti-corrosive to washing machine parts. Sodium silicates of $Na_2O/SiO_2$ ratios of from 1.6/1 to 1/3.2, especially about ½ to 1/2.8 are preferred. Potassium silicates of the same ratios can also be used.

The water insoluble crystalline and amorphous aluminosilicate zeolite builders can be used. The zeolites generally have the formula:

$$(M_2O)_x(Al_2O_3)_y(SiO_2)_zwH_2O)$$

wherein x is 1, y is from 0.8 to 1.2 and preferably, 1, z is from 1.5 to 3.5 or higher and preferably 2 to 3 and w is from 0 to 9,preferably 2.5 to 6 and M is preferably sodium. A typical zeolite is type A or similar structure, with type 4A particularly preferred. The preferred aluminosilicates have calcium ion exchange capacities of about 200 milli equivalents per gram or greater, e.g. 400 meg per gram.

Various crystalline zeolites (i.e. aluminosilicates) that can be used are described in British Patent No. 1,504,168, U.S. Pat. No. 4,409,136 and Canadian Patent Nos. 1,072,835 and 1,087,477, all of which are hereby incorporated by reference for such descriptions. An example of amorphous zeolites useful herein can be found in Belgium Patent No. 835,351 and this patent too is incorporated herein by reference.

Alkalinity buffers which may be added to the compositions of the invention include monoethanolamine, triethanolamine, borax and the like.

Hydrotropes which may be added to the invention include ethanol, sodium xylene sulfonate, sodium cumene sulfonate and the like.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401, 413 to Marriott and British Patent No. 461,221 to Marriott and Guan.

In addition, various other detergent additives or adjuvants may be present in the detergent product to give it additional desired properties, either of functional or aesthetic nature.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Optical brighteners for cotton, polyamide and polyester fabrics can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicon compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose,pH modifiers and pH buffers, color safe bleaches, perfume and dyes and bluing agents such as Iragon Blue L2D, Detergent Blue 472/572 and ultramarine blue can be used.

Also, soil release polymers and cationic softening agents may be used.

Another optional ingredient which may be used in the compositions of the invention is a deflocculating polymer.

In general, a deflocculating polymer comprises a hydrophilic backbone and one or more hydrophobic side chains and allows, if desired, the incorporation of greater amounts of surfactants and/or electrolytes than would otherwise be compatible with the need for a stable, low-viscosity product as well as the incorporation, if desired, of greater amounts of other ingredients to which lamellar dispersions are highly stability-sensitive.

The hydrophilic backbone generally is a linear, branched or highly crosslinked molecular composition containing one or more types of relatively hydrophilic monomer units where monomers preferably are sufficiently soluble to form at least a 1% by weight solution when dissolved in water. The only limitations to the structure of the hydrophilic backbone are that they be suitable for incorporation in an active-structured aqueous liquid composition and that a polymer corresponding to the hydrophilic backbone made from the backbone monomeric constituents is relatively water soluble (solubility in water at ambient temperature and at pH of 3.0 to 12.5 is preferably more than 1 g/1). The hydrophilic backbone is also preferably predominantly linear, e.g., the main chain of backbone constitutes at least 50% by weight, preferably more than 75%,most preferably more than 90% by weight.

The hydrophilic backbone is composed of monomer units selected from a variety of units available for polymer preparation and linked by any chemical links including —O—,

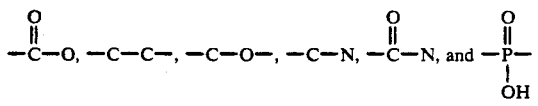

Preferably the hydrophobic side chains are part of a monomer unit which is incorporated in the polymer by copolymerizing hydrophobic monomers and the hydrophilic monomer making up the backbone. The hydrophobic side chains preferably include those which when isolated from their linkage are relatively water insoluble, i.e., preferably less than 1 g/1,more preferred less than 0.5 g/1, most preferred less than 0.1 g/1 of the hydrophobic monomers, will dissolve in water at ambient temperature at pH of 3.0 to 12.5.

Preferably, the hydrophobic moieties are selected from siloxanes, saturated and unsaturated alkyl chains, e.g., having from 5 to 24 carbons, preferably 6 to 18, most preferred 8 to 16 carbons, and are optionally bonded to hydrophilic backbone via an alkoxylene or polyalkoxylene linkage, for example a polyethoxy, polypropoxy, or butyloxy (or mixtures of the same) linkage having from 1 to 50 alkoxylene groups. Alternatively, the hydrophobic side chain can be composed of relatively hydrophobic alkoxy groups, for example, butylene oxide and/or propylene oxide, in the absence of alkyl or alkenyl groups.

Monomer units which made up the hydrophilic backbone include:

(1) unsaturated, preferably mono-unsaturated, $C_{1-6}$ acids, ethers, alcohols, aldehydes, ketones or esters such as monomers of acrylic acid, methacrylic acid, maleic acid, vinyl-methyl ether, vinyl sulphonate or vinylalcohol obtained by hydrolysis of vinyl acetate, acrolein;

(2) cyclic units, unsaturated or comprising other groups capable of forming inter-monomer linkages, such as saccharides and glucosides, alkoxy units and maleic anhydride;

(3) glycerol or other saturated polyalcohols.

Monomeric units comprising both the hydrophilic backbone and hydrophobic sidechain may be substituted with groups such as amino, amine, amide, sulphonate, sulphate, phosphonate, phosphate, hydroxy, carboxyl and oxide groups.

The hydrophilic backbone is preferably composed of one or two monomer units but may contain three or more different types. The backbone may also contain small amounts of relatively hydrophobic units such as those derived from polymers having a solubility of less than 1 g/1 in water provided the overall solubility of the polymer meets the requirements discussed above. Examples include polyvinyl acetate or polymethyl methacrylate.

Further examples of deflocculating polymer include those which are described in U.S. Pat. No. 4,992,194 to Liberati et al. and EP No. 346,995, both of which are hereby incorporated by reference into the subject application.

The deflocculating polymer generally will comprise, when used, from about 0.1 to about 5% of the composition, preferably 0.1 to about 2% and most preferably, about 0.5 to about 1.5%.

The list of optional ingredients above is not intended to be exhaustive and other optional ingredients which may not be listed but which are well known in the art may also be included in the composition.

Viscosity and pH

The compositions of the subject invention may be isotropic (i.e., having no structured lamellar phase) or structured. By structured is meant a composition having sufficient detergent active and, optionally, sufficient dissolved electrolyte to result in a structure of lamellar droplets dispersed in a continuous aqueous phase.

Lamellar droplets are a particular class of surfactant structures which are already known from a variety of references, e.g., H. A. Barnes, 'Detergents', Ch. 2 in K. Walters (Ed.), Rheometry: Industrial Applications; J. Wiley & Sons, Letchworth 1980.

In general, if a composition contains a lamellar phase, there is an upper limit to the volume fraction of the lamellar phase to have a pourable product. That is, although higher volume fraction leads to greater stability, it also leads to increased viscosity resulting in unpourable products. When volume fraction is 0.6 or higher, the droplets are just touching (space-filling) thereby allowing reasonable stability with an acceptable viscosity (say no higher than 2.5 Pas, preferably no more than 1 Pas at a shear rate of $21s^{-1}$). Volume Fraction also endows useful solids-suspending properties and conductivity measurements are known to provide a useful way of measuring volume fraction, when compared to the conductivity of the continuous phase.

If a deflocculating polymer is used, stable, pourable products wherein the volume function of the lamellar phase is 0.6 or higher can be made.

The volume fraction of the lamellar droplet phase may be determined by the following method. The composition is centrifuged, say at 40,000 G for 12 hours, to separate the composition into a clear (continuous aqueous) layer, a turbid active-rich (lamellar) layer and (if solids are suspended) a solid particle layer. The conductivity of the continuous aqueous phase, the lamellar phase and of the total composition before centrifugation are measured. From these, the volume fraction of the lamellar phase is calculated, using the Bruggeman equation, as disclosed in American Physics, 24, 636 (1935). When applying the equation, the conductivity of the total composition must be corrected for the conductivity inhibition owing to any suspended solids present. The degree of correction necessary can be determined by measuring the conductivity of a model system. This has the formulation of the total composition but without any surfactant. The difference in conductivity of the model system, when continuously stirred (to disperse the solids) and at rest (so the solids settle), indicates the effect of suspended solids in the real composition. Alternatively, the real composition may be subjected to mild centrifugation (say 2,000 G for 1 hour) to just remove the solids. The conductivity of the upper layer is that of the suspending base (aqueous continuous phase with dispersed lamellar phase, minus solids).

It should be noted that, if the centrifugation at 40,000 G fails to yield a separate continuous phase, the conductivity of the aforementioned model system at least can serve as the conductivity of the continuous aqueous phase. For the conductivity of the lamellar phase, a value of 0.8 mS (millisiemens) can be used, which is typical for most systems. In any event, the contribution of this term in the equation is often negligible.

Preferably, the viscosity of the aqueous continuous phase in such structurant systems (containing a defloculating polymer) is less than 25 mPas, most preferably less than 15 mPas, especially less than 10 mPas, these viscosities being measured using a capillary viscometer, for example an Ostwald viscometer. As indicated above, in non-structured systems, viscosities can be much higher, i.e., up to 20 Pas when measured at shear rate of $21s^{-1}$.

Sometimes, it is preferred for structured compositions to have solid-suspending properties (i.e., capable of suspending solid particles) and sometimes it may also be preferred that the compositions not have solid suspending properties.

In practical terms, i.e., as determining product properties, when a 'deflocculating' polymer is used in a structured liquid, this means that the equivalent composition, minus the polymer, has a significantly higher viscosity and/or becomes unstable. It is not intended to embrace polymers which would both increase the viscosity and not enhance the stability of the composition. It is also not intended to embrace polymers which would lower the viscosity simply by a dilution effect, i.e., only by adding to the volume of the continuous phase. Nor does it include those polymers which lower viscosity only by reduction the volume fraction (shrinking) of the lamellar droplets, as disclosed in our European patent application EP 301 883. Thus although relatively high levels of the deflocculating polymers can be used in those systems where a viscosity reduction is brought about; typically levels as low as from about 0.01% be weight to about 5.0% by weight can be capable of reducing the viscosity at $21s^{-1}$ by up to 2 orders of magnitude.

Preferred embodiments of such compositions exhibit less phase separation on storage and have a lower viscosity than equivalent compositions without any of the deflocculating polymer.

Without being bound by any particular interpretation or theory, the applicants have hypothesized that the polymers exert their action on the composition by the following mechanism. The hydrophobic side-chain(s) could be incorporated only in the outer bi-layer of the droplets, leaving the hydrophilic backbone over the outside of the droplets and additionally the polymers could also be incorporated deeper inside the droplet.

When the hydrophobic side chains are only incorporated in the outer bilayer of the droplets, this has the effect of decoupling the inter- and intra-droplet forces i.e., the difference between the forces between individual surfactant molecules in adjacent layers within a particular droplet and those between surfactant molecules in adjacent droplets could become accentuated in that the forces between adjacent droplets are reduced. This will generally result in an increased stability due to less flocculation and a decrease in viscosity due to smaller forces between the droplets resulting in greater distances between adjacent droplets.

When the polymers are incorporated deeper inside the droplets also less flocculation will occur, resulting in an increase in stability. The influence of these polymers within the droplets on the viscosity is governed by two opposite effects: firstly the presence of deflocculating polymers will decrease the forces between adjacent droplets resulting in greater distances between the droplets, generally resulting in a lower viscosity of the system; secondly the forces between the layers within the droplets are equally reduced by the presence of the polymers in the droplet, this generally results in an increase in the water layer thickness, therewith increasing the lamellar volume of the droplets, therewith increasing the viscosity. The net effect of these two opposite effects may result in either a decrease or an increase in the viscosity of the product.

It is conventional in patent specification describing aqueous structured liquid detergents to define the stability of the composition in terms of the volume separation observed during storage for a predetermined period at a fixed temperature. In fact, this can be an over-simplistic definition of what is observed in practice. Thus, it is appropriate here to give a more detailed description.

For lamellar droplet dispersions, where the volume fraction of the lamellar phase is below 0.6 and the droplets are flocculated, instability is inevitable and is observed as a gross phase separation occurring in a relatively short time. When the volume fraction is below 0.6 but the droplets are not flocculated, the composition may be stable or unstable. When it is unstable, a phase separation occurs at a slower rate than in the flocculated case and the degree of phase separation is less.

When the volume fraction of the lamellar phase is below 0.6, whether the droplets are flocculated or not, it is possible to define stability in the conventional manner. In the context of the present invention, stability for these systems can be defined in terms of the maximum separation compatible with most manufacturing and retail requirements. That is, the 'stable' compositions will yield no more than 2% by volume phase separation as evidenced by appearance of 2 or more separate layers when stored at 25° C. for 21 days from the time of preparation.

In the case of the compositions where the lamellar phase volume fraction is 0.6 or greater, it is not always easy to apply this definition. In the case of the present invention, such systems may be stable or unstable, according to whether or not the droplets are flocculated. For those that are unstable, i.e., flocculated, the degree of phase separation may be relatively small, e.g., as for the unstable non-flocculated systems with the lower volume fraction. However, in this case the phase separation will often not manifest itself by the appearance of a distinct layer of continuous phase but will appear distributed as 'cracks' throughout the product. The onset of these cracks appearing and the volume of the material they contain are almost impossible to measure to a very high degree of accuracy. However, those skilled in the art will be able to ascertain instability because the presence of a distributed separate phase greater than 2% by volume of the total composition will readily be visually identifiable by such persons. Thus, in formal terms, the above-mentioned definition of 'stable' is also applicable in these situations, but disregarding the requirement for the phase separation to appear as separate layers.

Especially preferred embodiments of the structured liquid aspect of the invention yield less than 0.1% by volume visible phase separation after storage at 25° C. for 90 days from the time of preparation.

It must also be realized that there can be some difficulty in determining the viscosity of an unstable liquid.

When the volume fraction of the lamellar phase is less than 0.6 and the system is deflocculated or when the volume fraction is 0.6 or greater and the system is flocculated, then phase separation occurs relatively slowly and meaningful viscosity measurement can usually be determined quite readily. For all structured compositions of the present invention it is usually preferred that their viscosity is not greater than 2.5 Pas, most preferably no more than 1.0 Pas, and especially not greater than 750 mPas at a shear rate of $21s^{-1}$.

When the volume fraction of the lamellar phase is less than 0.6 and the droplets are flocculated, then often the rapid phase separation occurring makes a precise determination of viscosity rather difficult. However, it is usually possible to obtain a figure which, while approximate, is still sufficient to indicate the effect of the deflocculating polymer in the compositions.

The pH of the liquid detergent dispersion/emulsion depends in part on the enzyme which is stabilized. For lipase stabilization, pH is in the range of 5 to 11.5, preferably 6 to 10 and for protease stabilization, pH is in the range of 6 to 12.5, preferably 8 to 11, more preferably 9 to 11.

The present invention is further illustrated by the following examples. The examples are not intended to be limiting in any way.

Example 1

The stability of both proteolytic enzyme and peroxygen bleach was tested in the following compositions and the following results were obtained.

| Ingredients | Composition (wt. %) 1.1 | 1.2 | 1.3 | 1.4 |
|---|---|---|---|---|
| Sodium $C_{12}$ Alkyl Benzene Sulfonate | 21.0 | 21.0 | 21.0 | 21.0 |
| Neodol 25-7* | 9.0 | 9.0 | 9.0 | 9.0 |
| Sodium Metaborate | 2.6 | 2.6 | 2.6 | 2.6 |
| Sodium Citrate | 10.0 | 10.0 | 10.0 | 10.0 |
| Dequest 2010 | 0.4 | 0.4 | 0.4 | 0.4 |
| Sodium Hydroxide | Neutralize to pH = 8.5 | | | |
| Calcium Chloride.$2H_2O$ | 0.15 | 0.15 | 0.15 | 0.15 |
| Sodium Perborate.$4H_2O$ | 20.0 | 20.0 | 20.0 | 20.0 |
| Decoupling Polymer** | 0.1 to 5% | | | |
| Polyacrylic acid of MW about 50,000 | 0.25 | 0.25 | 0.25 | 0.25 |
| SaVinase 16.0L | 0.75 | 0.75 | 0.75 | 0.75 |
| Water | to 100% | | | |
| Glycerol | 0.0 | 3.5 | 0.0 | 0.0 |
| Quat Pro E (Maybrook) | 0.0 | 0.0 | 2.0 | 0.0 |
| Catipro 30 (Maybrook) | 0.0 | 0.0 | 0.0 | 2.0 |
| Stability (enzyme) $t_{\frac{1}{2}}$ (days) at 37° C. | 4.4 | 7.9 | 20.6 | 21.6 |
| Stability (perborate) $t_{\frac{1}{2}}$ (months) at 40° C. | 9.5 | 2.6 | 4.5 | 4.2 |

*Condensation product of a mixture of higher fatty alcohols averaging 12 to 15 carbons and 7 moles ethylene oxide.

**Decoupling Polymer is an acrylic acid/lauryl methacrylate copolymer having a molecular weight of about 4000.

Quat Pro E is a triethonium hydrolyzed collagen and the Catipro 30 is an underivatized hydrolyzed collagen. By underivatized is meant that the natural protein does not have to be reacted with an amine to obtain a cationic protein and that a naturally occurring cationic protein can be isolated. Both are manufactured by Maybrook.

As can be seen from the results above, the proteins tested significantly increased enzyme stability (i.e., from 7.9 days for typical glycerol stabilizer to half lives of 20.6 and 21.6 days, respectively) while offering much greater perborate stability relative to the control stabilizer, i.e., glycerol. Specifically, stability of the perborate went from a half-life (in months) of 2.6 in the glycerol system to 4.5 and 4.2 months for the two proteins. Moreover, although perborate stability was lessened relative to the use of no stabilizer, when no stabilizer is used, the enzyme stability is very poor (i.e., half life of 4.4 days). Thus clearly, the use of the proteins offers the best results when using compositions containing both enzyme and perborate.

Example 2

Comparison of quaternized nitrogen proteins to non-quaternized proteins and comparison of effect of molecular weight The stability of both proteolytic enzyme and peroxygen bleach was tested in the following compositions and the following results obtained.

TABLE I

| Ingredients | Compositions (wt %) 2.1 | 2.2 | 2.3 | 2.4 | 2.5 | 2.6 | 2.7 | 2.8 |
|---|---|---|---|---|---|---|---|---|
| Sodium $C_{12}$ | 21.0 | 21.0 | 21.0 | 21.0 | 21.0 | 21.0 | 21.0 | 21.0 |

TABLE I-continued

| | | | | | | | | |
|---|---|---|---|---|---|---|---|---|
| Alkylbenzene Sulfonate (Anionic) | | | | | | | | |
| Neodol 25-7 (Nonionic) | 9.0 | 9.0 | 9.0 | 9.0 | 9.0 | 9.0 | 9.0 | 9.0 |
| Sodium Metaborate | 2.6 | 2.6 | 2.6 | 2.6 | 2.6 | 2.6 | 2.6 | 2.6 |
| Sodium Citrate | 10.0 | 10.0 | 10.0 | 10.0 | 10.0 | 10.0 | 10.0 | 10.0 |
| Dequest 2010* | 0.4 | 0.4 | 0.4 | 0.4 | 0.4 | 0.4 | 0.4 | 0.4 |
| Sodium Hydroxide | Neutralize to pH equals 8.5 | | | | | | | |
| Calcium Chloride.$2H_2O$ | 0.15 | 0.15 | 0.15 | 0.15 | 0.15 | 0.15 | 0.15 | 0.15 |
| Sodium Perborate.$4H_2O$ | 20.0 | 20.0 | 20.0 | 20.0 | 20.0 | 20.0 | 20.0 | 20.0 |
| Decoupling Polymer** | 0.1 to 5% | | | | | | | |
| Polyacrylic acid of MW about 50,000 | 0.25 | 0.25 | 0.25 | 0.25 | 0.25 | 0.25 | 0.25 | 0.25 |
| Savinase 16.0L | 0.75 | 0.75 | 0.75 | 0.75 | 0.75 | 0.75 | 0.75 | 0.75 |
| Water | to 100% | | | | | | | |

*Dequest 2010 hydroxyethylidene diphosphonic acid (sequestrant)
**Acrylic acid/lauryl methacrylate copolymer

| Proteins: | Compositions (wt %) | | | | | | | | |
|---|---|---|---|---|---|---|---|---|---|
| Ingredients | 2.2 | 2.2 | 2.3 | 2.4 | 2.5 | 2.6 | 2.7 | 2.8 | 2.9 |
| Solusilk (MW = 00) | 2.0 | 0.0 | 0.0 | 0.0 | 0.0 | 0.0 | 0.0 | 0.0 | 0.0 |
| AL55 (MW = 1,000) | 0.0 | 2.0 | 0.0 | 0.0 | 0.0 | 0.0 | 0.0 | 0.0 | 0.0 |
| IP10 (MW = 25,000) | 0.0 | 0.0 | 2.0 | 0.0 | 0.0 | 0.0 | 0.0 | 0.0 | 0.0 |
| Casein (MW = 50,000) | 0.0 | 0.0 | 0.0 | 2.0 | 0.0 | 0.0 | 0.0 | 0.0 | 0.0 |
| Quat pro s (MW = 10,000) | 0.0 | 0.0 | 0.0 | 0.0 | 2.0 | 0.0 | 0.0 | 0.0 | 0.0 |
| Quat pro e (MW = 4,000) | 0.0 | 0.0 | 0.0 | 0.0 | 0.0 | 2.0 | 0.0 | 0.0 | 0.0 |
| Catipro 30 (MW = 4,000) | 0.0 | 0.0 | 0.0 | 0.0 | 0.0 | 0.0 | 2.0 | 0.0 | 0.0 |
| Gelatin (MW = 100,000) | 0.0 | 0.0 | 0.0 | 0.0 | 0.0 | 0.0 | 0.0 | 2.0 | 0.0 |
| AC30 (MW = 6,000) | 0.0 | 0.0 | 0.0 | 0.0 | 0.0 | 0.0 | 0.0 | 0.0 | 2.0 |
| Stability (Enzyme)$t_{\frac{1}{2}}$ (days) at 37° C. | 11.0 | 36.2 | 20.6 | 3.6 | 25.0 | 20.6 | 21.6 | 3.9 | 17.3 |
| Stability (Perborate) $t_{\frac{1}{2}}$ (days) at 50° C. | 3.8 | 12.3 | 13.1 | 15.3 | 35.2 | 35.3 | 42.1 | 57.7 | 72.3 |

Half life of savinase in 3.5% glycerol is 7.9 days and half life of bleach is 5.1 days
Solusilk is hydrolyzed silk amino acids
AL55 is alkaline hydrolyzed collagen
IP10 is polyquaternary hydrolyzed collagen
Quat Pro S is steartrimonium hydrolyzed collagen
Quat Pro e is triethonium hydrolyzed collagen ethosulfate
Catipro 30 is underivatized hydrolyzed collagen
AC30 is cationic collagen As can be observed from the table above, the use of proteins having molecular weight below 50,000 (i.e., all except casein and gelatin) offered significant improvement in both enzyme and bleach stability relative to glycerol. Casein and gelatin offered no improvement in enzyme stability and thus, although they offer bleach stability, are of no use in compositions in which the stability of both enzyme and bleach is desired.

As can be further seen, quat pro s, quat pro e, catipro 30 and $AC_{30}$ (all cationic proteins) offered increased bleach stability relative to glycerol ranging from 7 to 12 fold increases (i.e. ranging from 35.2 to 72.3 days).

It should be noted that the perborate half-life data in Example 2 was obtained in solutions stored at 50° C. versus solutions stored at 40° C. for Examples 1, 3 and 4. This was done in order to expedite the half-life studies which can otherwise take many months. The temperature does not affect the ratio of one tested compound versus another, however, so long as they are all tested at the same temperature as is the case here.

Example 3

TABLE II

| | Composition (wt. %) | | | | | |
|---|---|---|---|---|---|---|
| Ingredients | 3.1 | 3.2 | 3.3 | 3.4 | 3.5 | 3.6 |
| Sodium $C_{12}$ Alkyl Benzene sulfonate | 21.0 | 21.0 | 21.0 | 21.0 | 21.0 | 21.0 |
| Neodol 25-7 | 9.0 | 9.0 | 9.0 | 9.0 | 9.0 | 9.0 |
| Sodium Metaborate | 2.6 | 2.6 | 2.6 | 2.6 | 2.6 | 2.6 |
| Sodium Citrate | 10.0 | 10.0 | 10.0 | 10.0 | 10.0 | 10.0 |
| Dequest 2010 | 0.4 | 0.4 | 0.4 | 0.4 | 0.4 | 0.4 |
| Sodium Hydroxide | Neutralize to pH = 8.5 | | | | | |
| Calcium Chloride.$2H_2O$ | 0.15 | 0.15 | 0.15 | 0.15 | 0.15 | 0.1 |
| Sodium Perborate.$4H_2O$ | 20.0 | 20.0 | 20.0 | 20.0 | 20.0 | 20.0 |
| Decoupling Polymer* | 0.1 to 5% | | | | | |
| Polyacrylic acid of MW about 50,000 | 0.25 | 0.25 | 0.25 | 0.25 | 0.25 | 0.25 |
| Savinase 16.OL | 0.75 | 0.75 | 0.75 | 0.75 | 0.75 | 0.7 |
| Water | to 100% | | | | | |
| Glycerol | 0.0 | 3.5 | 0.0 | 0.0 | 0.0 | 0.0 |
| Sodium Propionate | 0.0 | 0.0 | 5.0 | 0.0 | 0.0 | 0.0 |
| Sodium Acetate | 0.0 | 0.0 | 0.0 | 5.0 | 0.0 | 0.0 |
| Sodium Formate | 0.0 | 0.0 | 0.0 | 0.0 | 5.0 | 0.0 |
| Sodium Adipate | 0.0 | 0.0 | 0.0 | 0.0 | 0.0 | 5.0 |
| Stability (enzyme) $t_{\frac{1}{2}}$ (days) at 37° C. | 4.4 | 7.9 | 12.8 | 13.8 | 8.5 | 15.2 |
| Stability (perborate) | 9.5 | 2.6 | 16.5 | 14.2 | 2.7 | 7.9 |

TABLE II-continued

| Ingredients | Composition (wt. %) | | | | | |
|---|---|---|---|---|---|---|
| | 3.1 | 3.2 | 3.3 | 3.4 | 3.5 | 3.6 |
| $t_{\frac{1}{2}}$ (months) at 40° C. | | | | | | |

*Acrylic acid/lauryl methacrylate copolymer

This example shows that propionate and adipate unexpectedly shows far superior improvements in both enzyme stability and perborate stability relative to no stabilizer (i.e., example 3.1 where enzyme stability measured by half-life is only 4.4 days), to glycerol stabilizer (where perborate stability measured by half life is only 2.6 months compared to 7.9 months, 14.2 months, 16.5 months, respectively for adipate, acetate and propionate) or to formate (where perborate stability is 2.7 months). Further, although perborate stability is only 7.9 months for adipate, relative to 9.5 months in the absence of stabilizer, enzyme stability in absence of stabilizer is only 4.4 days versus 15.2 days. Clearly, the overall improvement in both enzyme and perborate stability using acetate, propionate or adipate relative to other carboxylates is surprising and unexpected.

Example 4

TABLE III

| Ingredients | Composition (wt. %) | | | |
|---|---|---|---|---|
| | 4.1 | 4.2 | 4.3 | 4.4 |
| Sodium $C_{12}$ Alkyl Benzene sulfonate | 21.0 | 21.0 | 21.0 | 21.0 |
| Neodol 25-7 | 9.0 | 9.0 | 9.0 | 9.0 |
| Sodium Metaborate | 2.6 | 2.6 | 2.6 | 2.6 |
| Sodium Citrate | 10.0 | 10.0 | 10.0 | 10.0 |
| Dequest 2010 | 0.4 | 0.4 | 0.4 | 0.4 |
| Sodium Hydroxide | Neutralize to pH = 8.5 | | | |
| Calcium Chloride.$2H_2O$ | 0.15 | 0.15 | 0.15 | 0.15 |
| Sodium Perborate.$4H_2O$ | 20.0 | 20.0 | 20.0 | 20.0 |
| Decoupling Polymer* | 0.1 to 5% | | | |
| Polyacrylic acid of MW about 50,000 | 0.25 | 0.25 | 0.25 | 0.25 |
| Savinase 16.0L | 0.75 | 0.75 | 0.75 | 0.75 |
| Lipase 100L | 1.0 | 1.0 | 1.0 | 1.0 |
| Water | to 100% | | | |
| Glycerol | 3.5 | 0.0 | 0.0 | 0.0 |
| Quat Pro E | 0.0 | 2.0 | 0.0 | 0.0 |
| Catipro 30 | 0.0 | 0.0 | 2.0 | 0.0 |
| Stability (lipase) $t_{\frac{1}{2}}$ (days) at 37° C. | 9 | 6 | 10 | 4 |
| Stability (Savinase) at 37° C. | 7.9 | 20.6 | 21.6 | 4.8 |
| Stability (perborate) (months) at 40° C. | 2.4 | 4.5 | 3.8 | 9.3 |

*Acrylic acid/lauryl methacrylate copolymer

This example shows that in addition to protease, lipase stability is also enhanced by the use of the protein molecule stabilizers of the invention. Thus, it can be seen that both quat pro E and catipro 30 not only significantly enhance enzyme stability (20.6 & 21.6 days respectively) of protease relative to the absence of stabilizer (example 4.4), but that both also enhance lipase stability (6 days & 10 days, respectively, versus 4 days). Thus, although perborate stability is greater in the absence of enzyme stabilizer (9.3 months), enzyme stability (protease or lipase) clearly suffers. In addition, perborate stability is significantly enhanced relative to use of glycerol stabilizer. Thus, the example clearly shows that to enhance both perborate and enzyme stability, the proteins of the invention are required.

With regard to use of glycerol stabilizer, although this enhances lipase stability as well as the proteins of the invention, as indicated above, stability of perborate is significantly lower relative to stability of perborate using the proteins of the invention. Thus, again, it can be seen that when both enzyme and overborate stability are desired, the proteins of the invention are by far the best choice for the job.

We claim:

1. A heavy duty liquid detergent composition comprising:

(a) at least one of an anionic, nonionic, cationic, ampholytic or zwitterionic surfactant or a mixture thereof in an amount of from about 5% to about 85% by weight;

(b) an effective amount of enzyme selected from the group consisting of proteases and lipases;

(c) a peroxygen bleach compound in a range of about 2.5% to about 25% by weight; and (d) a protein having a molecular weight of from about 1,000 to about under 50,000.

2. A composition according to claim 1, wherein the protein is a cationic protein.

3. A composition according to claim 1, wherein the protein has a molecular weight of from about 3,000 to about 30,000.

4. A composition according to claim 3, wherein the protein has a molecular weight of from about 4,000 to about 20,000.

5. A composition according to claim 2, wherein the protein has the following structure:

$$\text{Protein}-[Y-R_1-\overset{+}{N}(R_2)(R_3)(R_4)A^-]_x;$$

wherein Protein is a natural or hydrolyzed protein;

Y is an amino acid capable of reacting with a substituted tertiary or quaternary amino group on the protein structure;

$R_1$ is a saturated or unsaturated alkyl, aryl, alkaryl, ester of alkyl, aryl or alkaryl groups, amido, alkylamine, alkoxy or alkanol group having 0 to 20 carbon atoms;

$R_2$, $R_3$ and $R_4$ are saturated or unsaturated alkyl, aryl, amido, alkylamine, alkoxy, alkanol, alkylcarboxylate, alkyl sulfate, alkylsulfonate, arylsulfonate or arylsulfate groups to 20 carbon atoms;

$A^-$ is a neutralizing anion such as a halide; and $X=1$ to 100

6. A heavy duty liquid detergent composition comprising:

(a) at least one of an anionic, nonionic, cationic, ampholytic or zwitterionic surfactant or a mixture thereof in an amount of from about 5% to about 85% by weight;

(b) an effective amount of of proteolytic enzyme;

(c) a peroxygen bleach compound in a range of about 2.5% to about 25% by weight; and (d) a carboxylic acid selected from the group consisting of acetic acid, propionic acid, adipic acid and salts thereof.

7. A composition according to claim 2, wherein the protein is a hydrolyzed collagen.

8. A composition according to claim 7, wherein the hydrolyzed collagen has a molecular weight of under 10,000.

* * * * *